US007221321B2

(12) United States Patent
Reuss

(10) Patent No.: US 7,221,321 B2
(45) Date of Patent: May 22, 2007

(54) DUAL-FREQUENCY DUAL POLARIZATION ANTENNA

(75) Inventor: Terry Reuss, Gauteng (ZA)

(73) Assignee: Jasco Trading (Proprietary) Limited, Gauteng (ZA)

( * ) Notice: Subject to any disclaimer, the term of this patent is extended or adjusted under 35 U.S.C. 154(b) by 0 days.

(21) Appl. No.: 11/274,991

(22) Filed: Nov. 16, 2005

(65) Prior Publication Data

US 2006/0139212 A1 Jun. 29, 2006

(30) Foreign Application Priority Data

Nov. 17, 2004 (ZA) ..... 04/9203

(51) Int. Cl.
*H01Q 1/38* (2006.01)

(52) U.S. Cl. ..... 343/700 MS; 343/846

(58) Field of Classification Search ..... 343/700 MS, 343/846, 848, 702

See application file for complete search history.

(56) References Cited

U.S. PATENT DOCUMENTS

| | | | | |
|---|---|---|---|---|
| 5,410,323 | A * | 4/1995 | Kuroda | 343/700 MS |
| 6,100,849 | A * | 8/2000 | Tsubaki et al. | 343/702 |
| 6,150,981 | A * | 11/2000 | Suguro et al. | 343/700 MS |
| 6,437,744 | B1 * | 8/2002 | Akiyama et al. | 343/700 MS |
| 6,801,167 | B2 * | 10/2004 | Shibata | 343/700 MS |
| 7,034,752 | B2 * | 4/2006 | Sekiguchi et al. | 343/700 MS |
| 7,075,486 | B2 * | 7/2006 | Suzuki | 343/700 MS |
| 2001/0050638 | A1 * | 12/2001 | Ishitobi et al. | 343/700 MS |
| 2002/0047803 | A1 * | 4/2002 | Ishitobi et al. | 343/700 MS |
| 2003/0184480 | A1 * | 10/2003 | Shibata | 343/700 MS |

* cited by examiner

*Primary Examiner*—Hoanganh Le
(74) *Attorney, Agent, or Firm*—Ladas & Parry LLP

(57) ABSTRACT

An antenna includes a multi sided electrical conductor forming a ground plane has two diagonals of different lengths. A multi sided electrical conductor forming a radiator has two diagonals of different lengths and a dielectric substrate is connected to the ground plane and to the radiator thereby to separate the ground plane from the radiator.

7 Claims, 4 Drawing Sheets

DUAL-FREQUENCY DUAL POLARIZATION ANTENNA

BACKGROUND OF THE INVENTION

This invention relates to an antenna, particularly to a dual frequency dual polarised patch antenna with applications for satellite communication systems.

SUMMARY OF THE INVENTION

In one aspect an antenna includes:

a multi sided electrical conductor forming a ground plane, wherein two diagonals of the ground plane are of different lengths;

a multi sided electrical conductor forming a radiator wherein two diagonals of the radiator are of different lengths; and a dielectric substrate connected to the ground plane and to the radiator thereby to separate the ground plane from the radiator.

DESCRIPTION OF EMBODIMENTS

Figure 1:
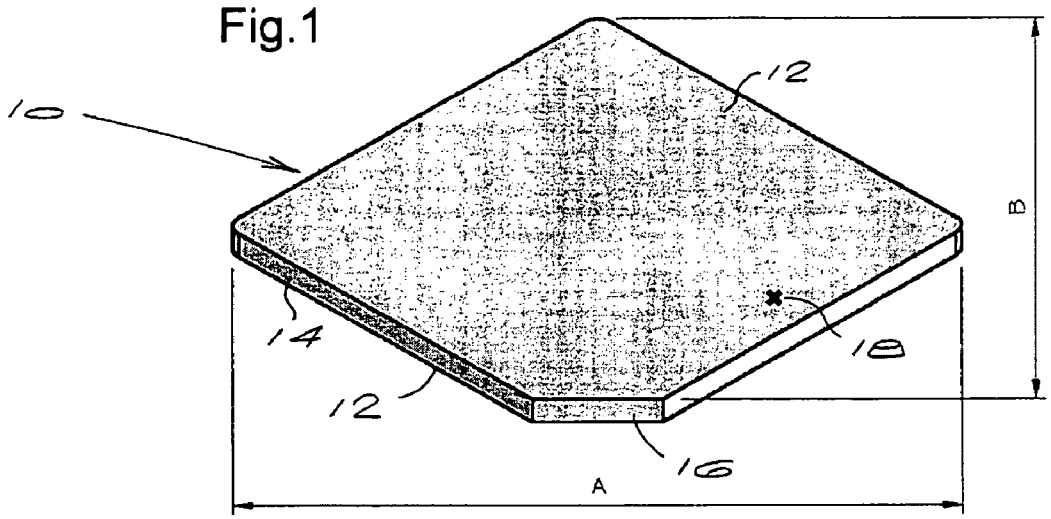
FIG. 1 is a schematic representation of a first embodiment of an antenna.

Referring to FIG. 1, an antenna 10 according to the present invention comprises a square or rectangular electrical conductor 12 forming a ground plane.

A square or rectangular electrical conductor forms a radiator 12.

The ground plane and the radiator are connected to a dielectric substrate 14, on opposing sides of the dielectric substrate that separates the two.

It will be appreciated that in one example, the ground plane, radiator and dielectric substrate are of substantially the same shape.

The dielectric substrate of a prototype was manufactured from a material consisting of titanium dioxide powder, a dispersant and a polyester resin that cures with the addition of a catalyst. The powder is mixed with the resin and dispersant and cast into a slab. The ratio of the powder to the resin is greater than 2:1.

The diagonals of the ground plane, radiator and dielectric substrate are of different lengths. Thus, the diagonal indicated as having length "A" is different from the length of the diagonal indicated as having length "B". Diagonal for example refers to a line segment connecting two non-adjacent vertices of a polygon.

This difference is effected by cutting off one of the corners 16.

Figure 3:
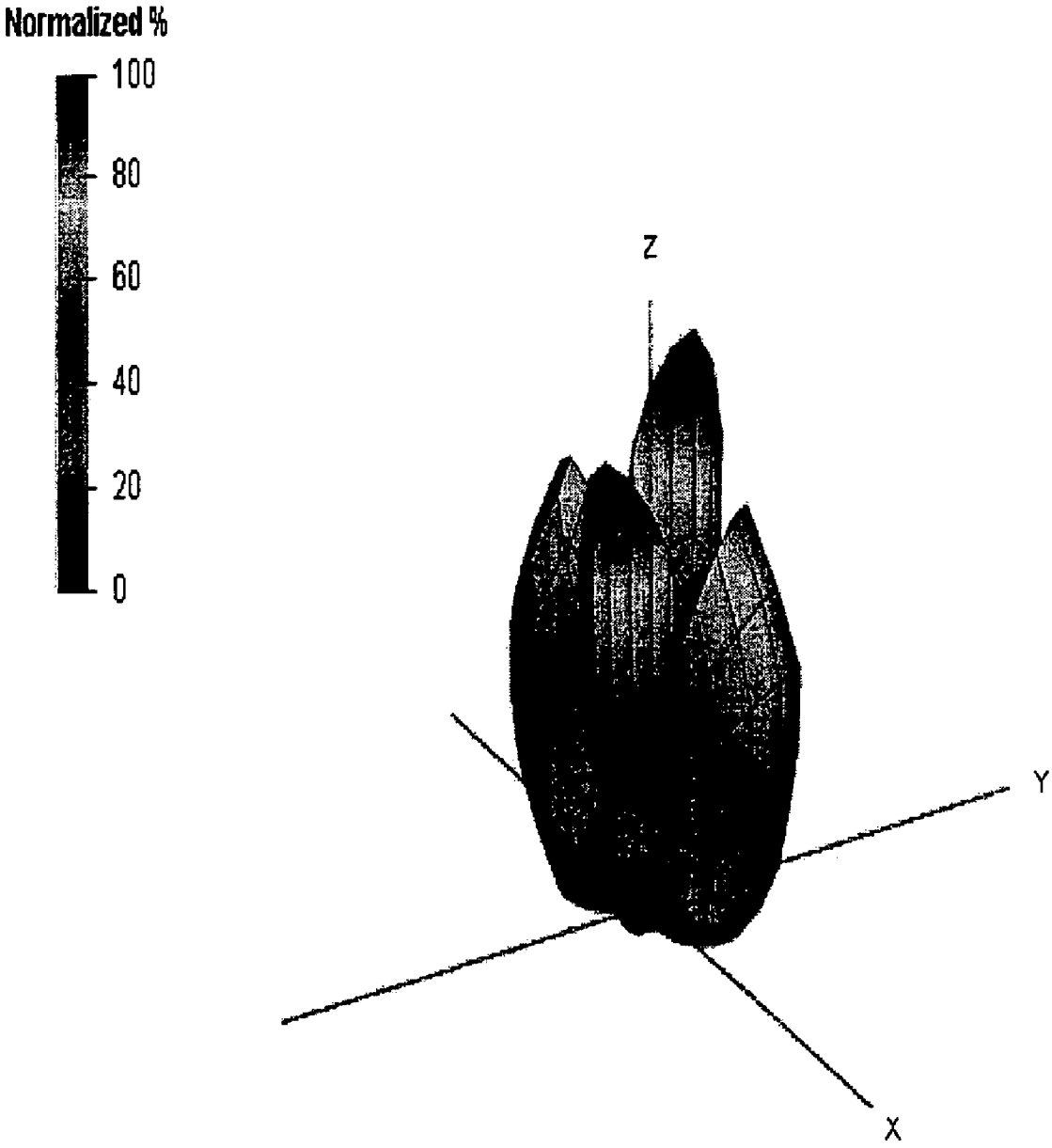
FIGS. 3 and 4 illustrates the Horizontal and Vertical radiation pattern of the antenna of FIG. 1 at the two resonant frequencies.
Figure 4:
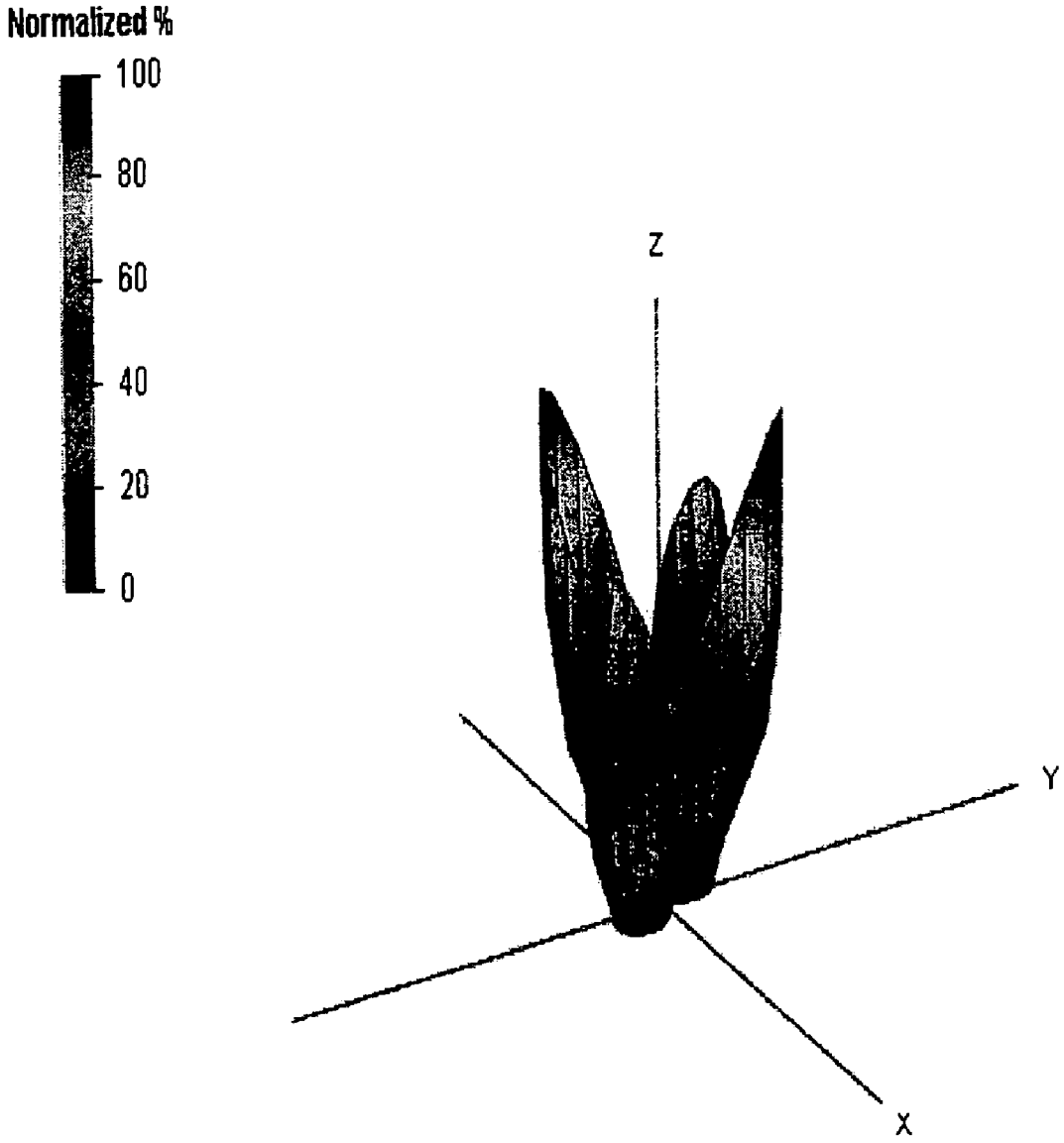

The surface current at the lower frequency flows along the length of diagonal A and the current at the higher frequency flows along the diagonal B. This produces electromagnetic waves with orthogonal polarization. E and H plane radiation patterns are shown in FIGS. 3 and 4.

A coaxial feed point is connected to the radiator in the centre of one of the shortages 18.

Figure 2:
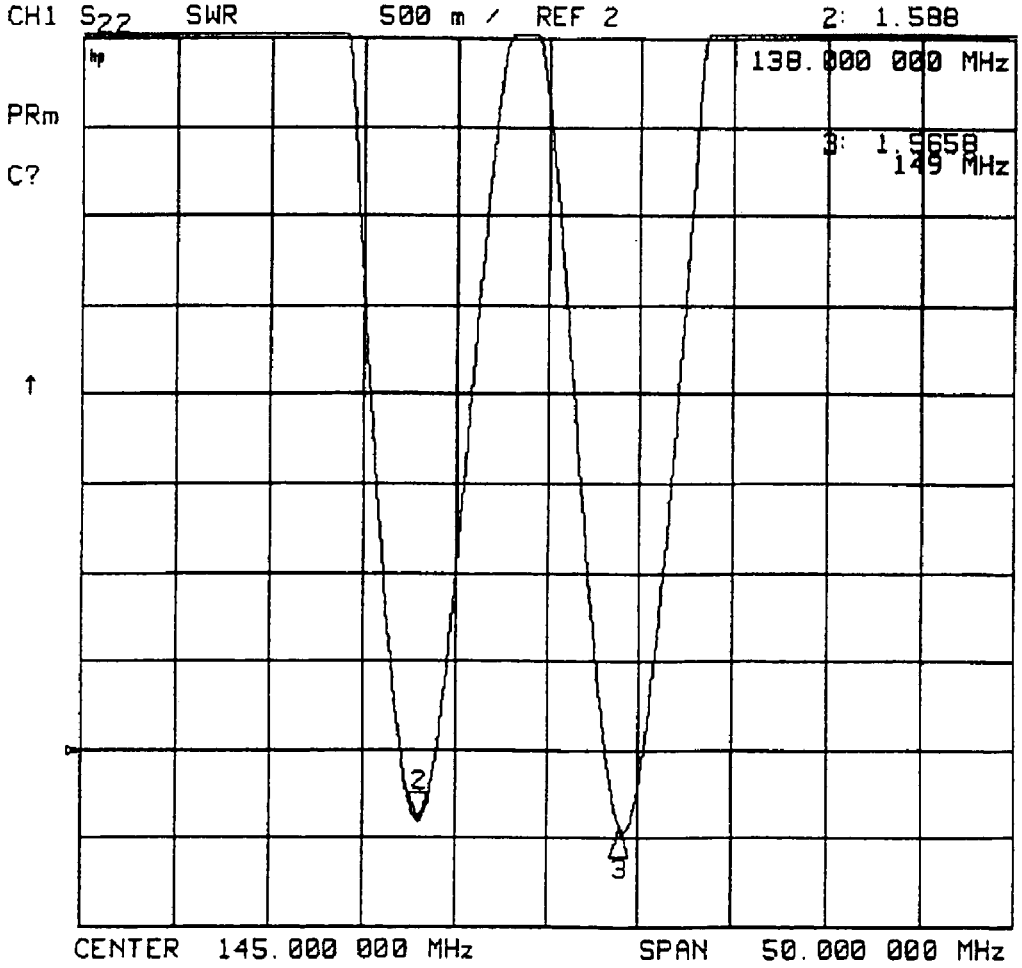
FIG. 2 is a VSWR plot of the antenna of FIG. 1.

The different length diagonals produce a dual frequency operation. This is illustrated in FIG. 2.

Figure 5:
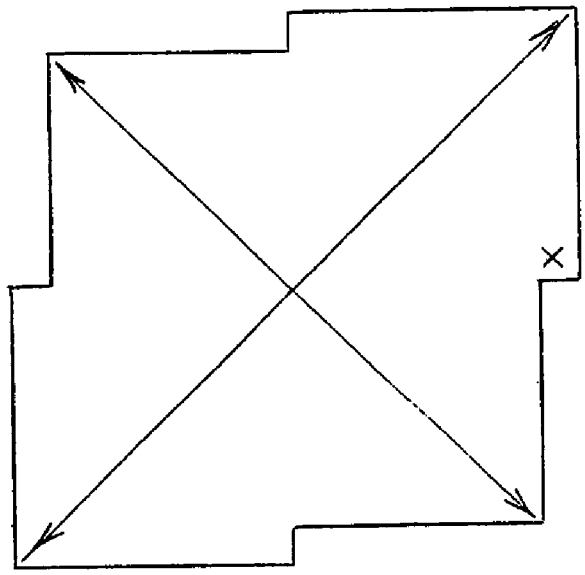
FIG. 5 illustrates a schematic representation of a second embodiment of an antenna.

FIG. 5 illustrates a second embodiment wherein the electric conductor forming the radiator is multi sided but still includes two diagonals of different lengths.

Figure 6:
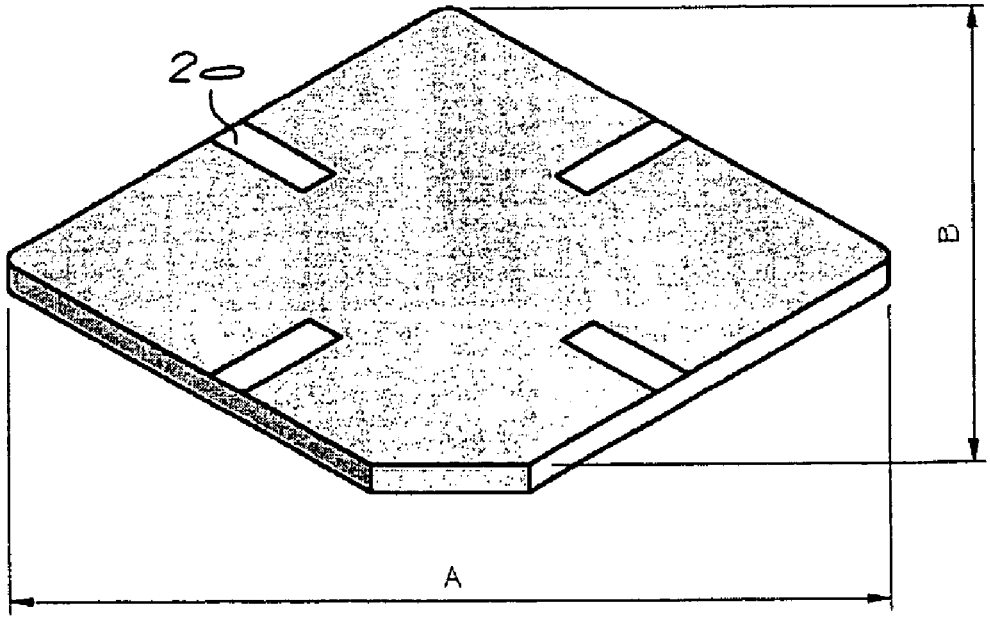
FIG. 6 illustrates a schematic representation of a third embodiment of an antenna.

FIG. 6 illustrates a third embodiment invention wherein the electric conductor forming the radiator is removed to provide for non-conductive slots 20.

The slots 20 begin at or near the edges of the radiator and extend inwardly towards a centre point of the radiator.

The slots 20 lower the resonant frequency of the antenna.

The antenna can be used for the transmission and reception of satellite communications at two frequencies.

In a prototype antenna, for a frequency of operation of 140 MegaHertz and 150 MegaHertz, the dimensions of the antenna include a 15 mm thick dielectric substrate with a relatively permittivity ER in the order of 10.

The longer diagonal is approximately 390 mm and the shorter diagonal is approximately 350 mm. The slots are approximately 20 mm wide and 70 mm long.

A prototype of the antenna produced resonant frequencies of 137.5 and 149 respectively being a frequency ratio of 1.084.

The invention claimed is:

1. A dual frequency, dual polarization antenna including:

a first planar and substantially rectangular dielectric substrate having first and second opposing sides;

a first planar and substantially rectangular electrical conductor attached to said first side of said dielectric substrate, forming a ground plane;

a second planar and substantially rectangular electrical conductor attached to said second side of said dielectric substrate thereby forming a radiator;

wherein said first and second substantially rectangular conductors have one, and the same single corner cut off such that diagonal dimensions of the first and second conductors measured between opposing corners of said first and second conductors, are of different lengths, the different lengths of the diagonals of the first and second conductors providing the antenna with two different resonant frequencies, the different diagonal lengths corresponding to said two different resonant frequencies, and wherein the radiator has four non-conductive slots formed therein, the non-conductive slots lowering the resonant frequencies.

2. An antenna according to claim 1 wherein the dielectric substrate is of a constant thickness.

3. An antenna according to claim 1 wherein the dielectric substrate includes two diagonals of different lengths.

4. An antenna according to claim 3 wherein the radiator and dielectric substrate are of substantially the same shape.

5. An antenna according to claim 1 wherein a co-axial feed point is connected to the radiator in the center of a shorter side of the radiator, near the edge of the radiator.

6. An antenna according to claim 1 wherein the two resonant frequencies are at approximately 140 MHz. and 150 MHz.

7. An antenna according to claim 6 wherein one of the corners of the dielectric substrate is cut off.

* * * * *